US005117602A

United States Patent [19]

Marschak

[11] Patent Number: 5,117,602

[45] Date of Patent: Jun. 2, 1992

[54] STRUCTURAL PANEL FOR PRE-FABRICATED BUILDINGS

[76] Inventor: Howard J. Marschak, 2030 Silvertip La., Long Beach, Ind. 46360

[21] Appl. No.: 742,194

[22] Filed: Aug. 2, 1991

Related U.S. Application Data

[63] Continuation of Ser. No. 591,931, Oct. 2, 1990.

[51] Int. Cl.[5] ..... E04B 7/02

[52] U.S. Cl. ..... 52/376; 52/732; 52/729; 52/581

[58] Field of Search ..... 52/588, 589, 763, 376, 52/729, 732, 578, 581, 584, 591, 593, 406, 407

[56] References Cited

U.S. PATENT DOCUMENTS

| | | | |
|---|---|---|---|
| 3,820,295 | 6/1974 | Folley . | |
| 3,969,866 | 7/1976 | Kyne . | |
| 4,168,596 | 9/1979 | Yoder, Jr. . | |
| 4,450,970 | 5/1984 | Shepherd | 52/588 |
| 4,546,590 | 10/1985 | Finch et al. | 52/588 |
| 4,561,233 | 12/1985 | Harter et al. | 52/588 |
| 4,594,822 | 6/1986 | Marschak | 52/376 |
| 4,691,493 | 9/1987 | Larsen | 52/581 |
| 4,800,696 | 1/1989 | Miller et al. | 52/729 |
| 4,817,357 | 4/1989 | Hocevar | 52/729 |

OTHER PUBLICATIONS

StructAll Metal Building System, A Technological Break Thru In Building Construction, The Profit Opportunity of a Lifetime HJM Industrial Design, Howard J. Marschak (Jul. 14, 1988).

*Primary Examiner*—David A. Scherbel
*Assistant Examiner*—Wynn Wood
*Attorney, Agent, or Firm*—Emrich & Dithmar

[57] ABSTRACT

A structural member having a elongated front panel with lateral ends. Side panels extend generally perpendicularly from the front panel at each of the lateral ends; each of the side panels has a generally Z-shaped portion, a first flange at the end of each side panel extending toward the other side panel generally parallel to said front panel, and a second flange at the end of the first flange generally perpendicular thereto extending away from the front panel. Adjacent cooperating structural members are nestable with each other at the Z-shaped portions thereof with the first and second flanges of nested side panels cooperating to form a receptacle for a stud or joist to form a wall or a floor/ceiling combination for a rapidly constructed pre-fabricated structure.

20 Claims, 2 Drawing Sheets

STRUCTURAL PANEL FOR PRE-FABRICATED BUILDINGS

This is a file wrapper continuation of application Ser. No. 591,931, filed Oct. 2, 1990.

BACKGROUND OF THE INVENTION

The present invention relates to building construction anc more particularly to an improved structural panel for use in erecting buildings wherein the panels may be used both as wall members and as floor/ceiling members.

The use of preformed panels for erecting building constructions has been known for many years. Examples of various types of building constructural components are disclosed in U.S. Pat. No. 3,820,295; 3,969,866; 4,168,596 and applicant's prior U.S. Pat. No. 4,594,822, all incorporated herein by reference.

In the construction industry, particularly residential construction, certain standards have been developed which are used almost universally in the United States. For example, most residential constructions utilize the standard "2×4" studs for the outer walls as well as the partitions defining inner walls. Conventionally, the roof structure is formed utilizing larger support members or studs such as "2×6" or "2×8" studs or rafters. Similarly, floor joists are usually "2×10" or "2×12" members. In all instances, that is the wall studs and the floor joists as well as the roof joists and rafters, the center-to-center spacing between two adjacent studs or joists has been standardized to be 16 inches.

For a long time, there has been needed in the construction industry, a mechanism to fabricate large panels or walls on site in order to reduce the amount of labor necessary to construct a building. Labor costs in building construction has become one of the most significant costs and prefabricated panels provide an extremely efficient mechanism for reducing the amount of labor required to construct a building. Accordingly, the present invention fulfills a need for a panel construction in the industry which can be made of various heights or longitudinal dimensions in order to prefabricate at the site, panels which may be anywhere from one to four stories high.

SUMMARY OF THE INVENTION

According to the present invention, a unique constructional panel has been developed which can be utilized with conventional studs and/or joists to span the space between adjacent studs or joists. More particularly, the structural panel is designed to have 16 inch center-to-center spacing with a particular flange construction such that cooperating adjacent panels form a receptacle for the wall studs or floor joists. The same panels may be used either as exterior walls or floor/ceiling combinations.

An object of the invention is to provide a structural member having an elongated front panel with lateral ends, side panels extending generally perpendicularly from the front panel and joined thereto at a respective one of the lateral ends, each of the side panels having a generally Z-shaped portion therein, a first flange at the end of each side panel extending toward the other side panel generally parallel to the front panel, and a second flange at the end of the first flange generally perpendicular thereto extending away from the front panel, whereby adjacent cooperating structural members are nestable with each other at the Z-shaped portions thereof with the first and second flanges of nested side panels cooperating to form a receptacle for a stud or joist.

Another object of the invention is to provide a plurality of structural members connected together forming a building wall or ceiling and floor, each structural member having an elongated front panel with lateral ends and side panels extending generally perpendicularly from the front panel and joined thereto at a respective one of the lateral ends, each of the side panels having a generally Z-shaped portion therein and a first flange at the end of each side panel extending toward the other side panel generally parallel to the front panel and a second flange at the end of the first flange generally perpendicular thereto extending away from the front panel, adjacent structural members being nested with each other at the Z-shaped portions thereof with the first and second flanges of nested side panels cooperating to form a receptacle for a wall stud or floor joist, and means connecting adjacent side panels to form a building wall or ceiling and floor a plurality of parallel elongated receptacles for wall studs or floor joists.

A final object of the invention is to provide a building including a plurality of structural members connected together forming interconnected walls and floors, each structural member having an elongated front panel with lateral ends and side panels extending generally perpendicularly from the front panel and joined thereto at a respective one of the lateral ends, each of the side panels having a generally Z-shaped portion therein and a first flange at the end of each the panel extending toward the other side panel generally parallel to the front panel and a second flange at the end of the first flange generally perpendicular thereto extending away from the front panel, means connecting adjacent side panels to form the building walls and floors with the first and second flanges of each two connected side panels forming a longitudinally extending receptacle for a wall stud or floor joist, a wall stud positioned in vertically extending receptacles extending upwardly from near the bottom-most floor and extending downwardly from near the upper-most ceiling, an end panel horizontally extending across the tops of the wall forming structural members enclosing the tops of same, means for connecting the end panels to the structural members, a floor joist positioned in horizontally extending receptacles, means supporting and maintaining the floor-forming structural members with respect to the associated wall studs, the floor forming structural members having the front panels thereof forming a ceiling and the floor joists providing support for a floor to be positioned thereupon.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 2:
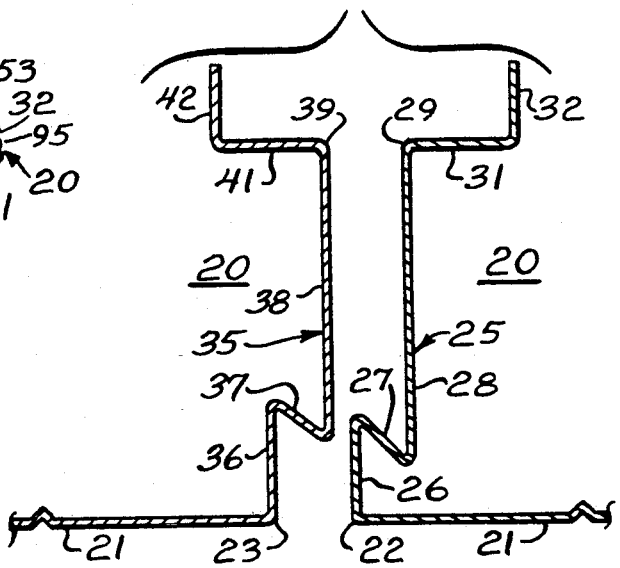
FIG. 2 is an end sectional view of a pair of structural panels showing the panels about to be nested.
Figure 3:
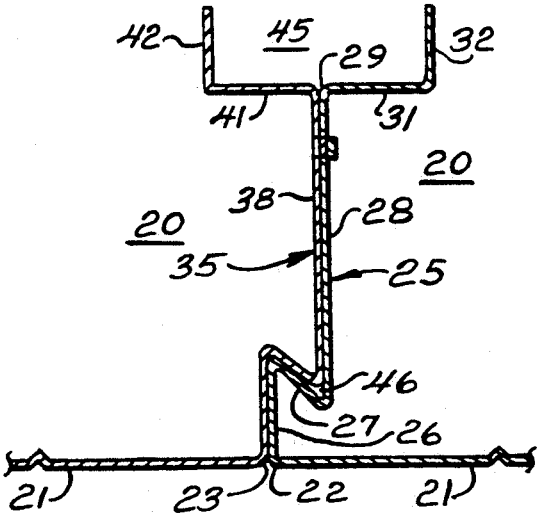
FIG. 3 is a view like FIG. 2 with the panels nested and secured one to the other.
Figure 4:
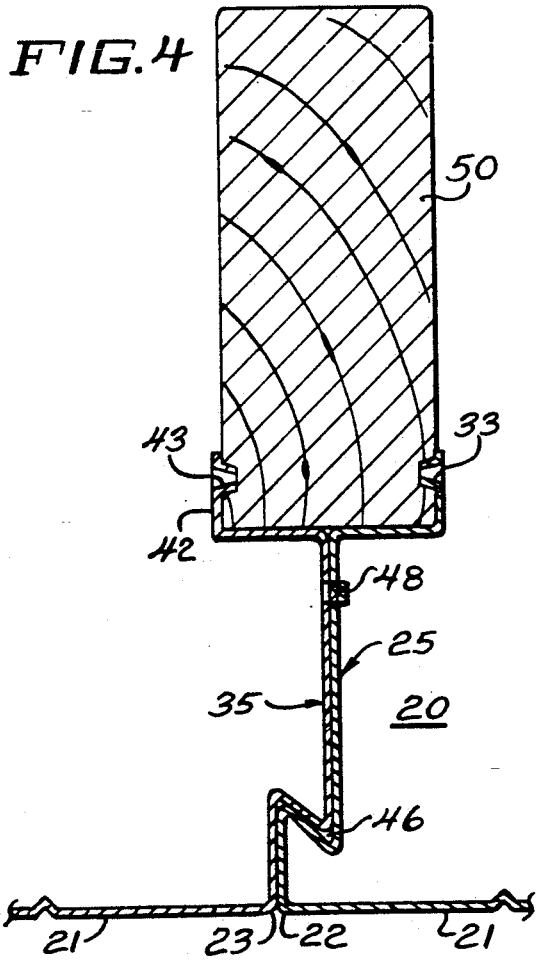
FIG. 4 is a view like FIG. 3 with a wall stud or floor joist in position and secured to the structural panel.
Figure 5:
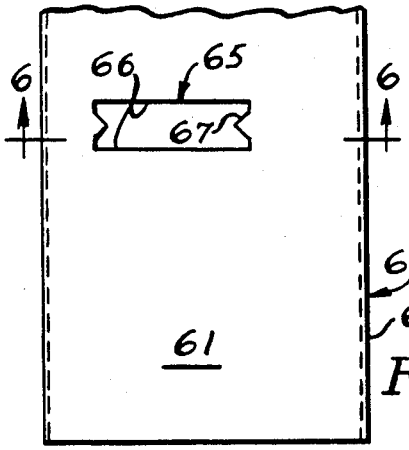
FIG. 5 is a view of a top or closure plate used in connection with a series of panels forming a wall structure.
Figure 6:
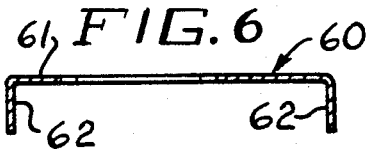
FIG. 6 is a sectional view of the cover plate of FIG. 5 as seen along lines 6—6 thereof.
Figure 8:
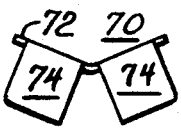
FIG. 8 is a top view of the fixture illustrated in FIG. 7.
Figure 7:
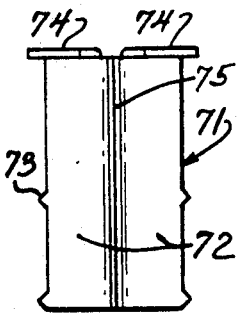
FIG. 7 is an elevational view of a fixture used to mount the cover plate to the wall.

Referring now to the drawings and particular FIGS. 2–4, there is illustrated a structural member 20 which may be used to form an upstanding wall 80 or a floor/-ceiling combination 90. Each of the structural members 20 include a front panel 21 having a lateral end 22 at the left hand side of the panel as seen in FIGS. 2–4 and a lateral end 23 at the right hand side of the panel, it being understood that FIGS. 2–4 are transverse cross sections of the structural member 20 and that a single structural member 20 includes the right-hand portion of FIG. 3 and the left-hand portion of FIG. 4, so that member 20 is as though FIGS. 3 and 4 are connected with a unitary front panel 21 ending at left end 22 and right end 23. At the left hand end of the structural member 20 is a side panel 25 having a straight section 26 extending perpendicularly to the front panel 21 at lateral end 22. The straight section 26 terminates in an angled section 27 which extends angularly toward the front panel 21 and leads to another straight section 28 perpendicular to the front panel 21 and inwardly offset with respect to the straight section 26. The straight offset section 28 terminates at an end 29 from which extends a first flange 31 perpendicular to the offset straight section 28 and parallel to the front panel 21. Connected to the end of the first flange 31 is a second flange 32 generally perpendicular to the flange 31 and the front panel 31.

At the right-hand side of the front panel 21 as seen in FIGS. 2–4, there is a side panel 35 which has a straight section 36 somewhat longer in length than section 26 and substantially perpendicular to the front panel 21 of the structural member 20. The straight section 36 extends upwardly from the end 23 and terminates in a downwardly and outwardly extending angled section 37 which leads to an offset straight section 38 generally perpendicular to the front panel 21. The straight section 38 is somewhat smaller than the straight section 28 to account for the difference in angle between the sections 36 and 37 and the difference in angle formed by the sections 36 and 37 and the angle formed by the sections 26 and 27 and the difference in the extent of sections 26 and 36, all as will be explained hereafter.

Figure 1:
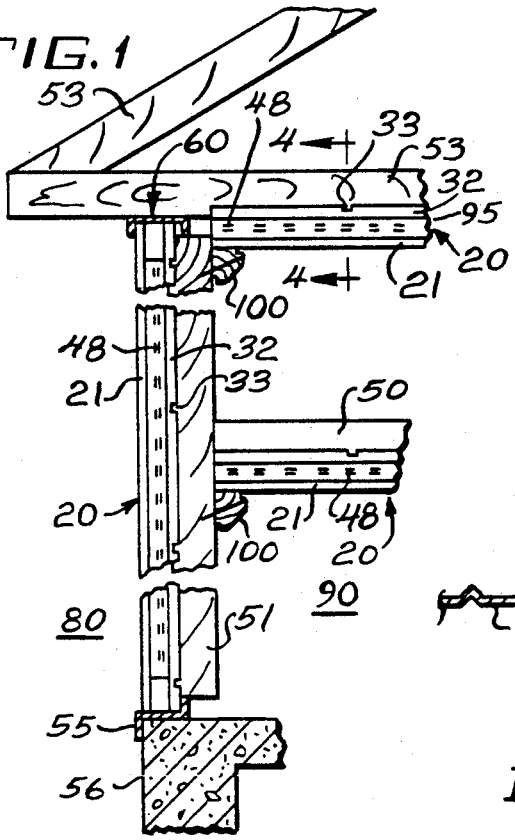
FIG. 1 is a schematic elevational view of a portion of a building constructed with the panels of the present invention.

Section 38 terminates in an end 39 from which extends a first flange 41 which is parallel to the front panel 21 and has the same extent as the first flange 31 and is co-planar therewith. Similarly, the flange 41 terminates in a second flange 42 perpendicular to the front panel 21, parallel to the flange 38 and having the same extent as the corresponding flange 32 at the other end of the panel 25. When two structural members 20 are nested as illustrated in FIGS. 3 and 4, the first flanges 31 and 41 cooperate with the second flanges 32 and 42 to form a receptacle 45 extending the longitudinal extent of the structural panel 20 which may be in the range of from five to forty feet depending on the height of the structure being built which is dimensioned to receive a standard construction timber in the form of a floor joist 50 as illustrated in FIG. 4 or in the form of a wall stud 51 or a roof joist 52 as illustrated in FIG. 1. In addition to the receptacle 45 being formed by the nesting of two structural members 20, there is also provided an elongated space 46 between the end panels 25 and 35 and particularly at the Z-shaped portions formed by the sections 26, 27 and 28 on the one end and 36, 37 and 38 on the other end of member 20. This elongated space 46 as seen in FIGS. 3 and 4 may be used for insulation purposes by providing caulking in the space 46 prior to the time that adjacent structural members 20 are nested. That is by providing a bead of caulk in the angle formed at the juncture of sections 26 and 27 prior to the nesting of two members 20 to form space 46.

The side panels 25 and 35 are spot fastened by any suitable technique, no prefinished material would weld, but the preferred technique is a new joining technique provided by a Trumfp power fastener TF300-2 which mechanically deforms and expands one side panel into the other side panel as at 48 to provide frictional interlocking of nested structural members. This machine is portable, easy to use and provides extremely good mechanical interconnection of one structural member 20 to another.

Prior to or after a plurality of structural members 20 are connected in the fashion previously discussed and erected as a wall 80, wall studs 51 are inserted into each receptacle 45 and maintained in place by punching a portion of the flanges 32 and 42 into the stud, as illustrated in FIG. 1 and indicted by the reference numerals 33 and in FIG. 4 indicated by the reference numerals 33 and 43 for a floor joist 50. The vertical spacing between punches is not a feature of the invention but may be approximately 12 inches. When a wall 80 is constructed of connected structural members 20, the front panels 21 thereof form the outside of the wall 80 and are available either in plain steel or in a variety of decorative finishes. The wall studs 51 may be normal "2×4's" or any other acceptable construction timber. In a preferred embodiment, the interior distance between second flanges 32 and 42 is 1½ inches to accommodate a normal "2×4" which has a thickness of 1½ inches. Also in a constructional example, the angle between the section 27 and the section 26 is about 45° whereas the angle between the section 37 and 36 is about 52½ thereby to provide the elongated space 46 between adjoining side panels 25 and 35. Also in a constructional example, the length of the second flanges 32 and 42 is about ¾ of an inch and the length of the side panels 36 and 38 and 26 and 28 is about 2 and 17/32 inches. The front panel 21 and the side panels 25, 35 are dimensioned such that adjacent studs or joists 50, 51 are on 16 inch centers. It is intended that these dimensions are for instructional purposes only and it is clear that certain of these dimensions may be changed while still incorporating basis of the invention.

Figure 9:
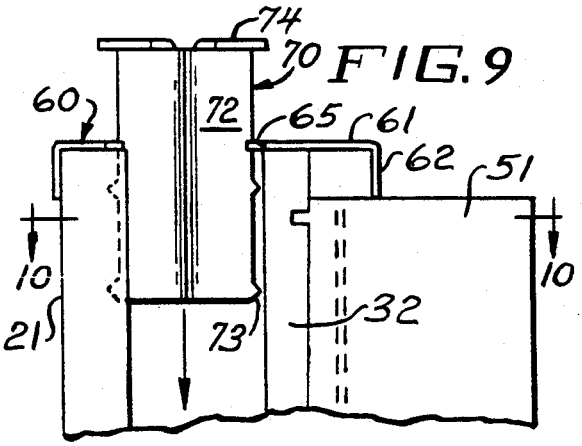
FIGS. 9–11 are sequential illustrations of the mounting of the fixture to the cover plate and wall panel.
Figure 12:
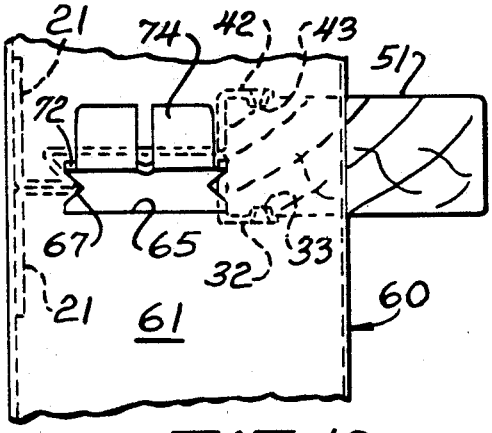
FIG. 12 is a top view of the cover plate mounted to the wall panel.
Figure 10:
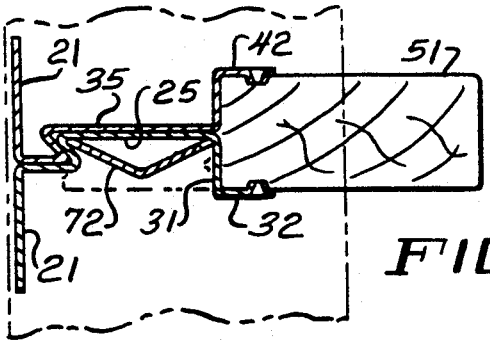
Figure 11:
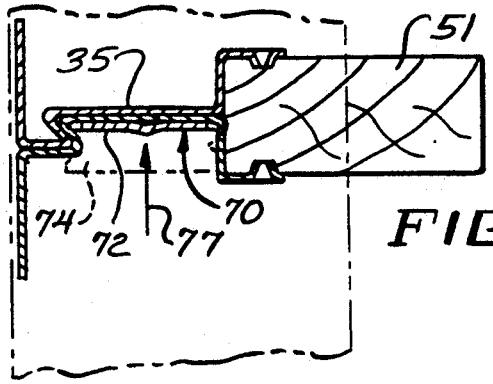

When a plurality of structural members 20 are interconnected to form a wall 80 as illustrated in FIG. 1, the wall 80 is mounted on a bottom plate 55 which is connected to a foundation 56 in the usual manner. A top plate 60 is used to enclose the openings of the wall 8 formed by the interconnected structural members 20, the top plate 60 being in the form of an elongated flat plate 61 having downwardly extending legs 62, as best seen in FIGS. 1 and 9. The top plate 60 further includes a series of apertures 65 spaced at 16 inch intervals along the longitudinal extent of the top plate 60 in order to align with the Z-shaped portions of each of the connected structural members 20. Each aperture 65 is generally rectangular in shape having two parallel side edges 66 extending transverse to the longitudinal direction of the top plate 60 and two V-shaped ends 67 with the V's extending inwardly. The apertures 65 are aligned so that the V's overlie each nested Z-shaped portion of the side flanges 25 and 35 at each juncture of adjacent structural members 20. The top plate 60 is connected to and maintained in place with respect to the wall 80 formed of connected structural members 20 by means of a plurality of fixtures 70, each fixture 70 being adapted to interconnect the top plate 60 with an associated nested pair of structural members 20. The fixture 70 includes a generally rectangular metal body 71 which is bent along a longitudinal mid axis 75 into two angularly disposed sections 72, the longitudinal edges of which are provided with outwardly extending nibs 73. The top of each angularly disposed rectangular section 72 is a tab 74 which is generally perpendicular to the section 72 and extends outwardly away therefrom, as best seen in FIGS. 7–12, inclusive.

As best seen in FIGS. 9–12, each fixture 70 is positioned in a slot 65 to fit loosely between the first flange 31 and the juncture between the side panel 25 and the angled section 27 until the tabs 74 are in contact with the top plate 60 and particularly the cover portion or flat portion 61 thereof. Thereafter, force is applied in the direction of the arrow 77 to flatten and expand the fixture body 71 from the condition shown in FIG. 10 to that shown in FIG. 11 so as to provide a rigid connection between the top plate 60 and the nested structural members 20 forming the wall 80. As seen particularly in FIG. 9, the downwardly extending flanges 62 of the cover or top plate 60 overlap the front panel 21 forming the outside skin of the wall 80 and contact the wall stud 51 on the inside of the wall, thereby completely to enclose the top of the wall 80 formed by the plurality of connected structural members 20.

When a plurality of structural members 20 are interconnected so as to form a floor/ceiling combination 90, as seen in FIG. 1, the ceiling portion is formed by the front panels 21 and the corresponding floor is formed by floor joists 50 positioned in the receptacles 45 formed by the cooperation of adjoining structural members 20, as previously described. It is well within the skill of the art to provide sufficient holes in the ceiling to accommodate wiring and HVAC, as required. When a ceiling roof combination 95 is formed from a plurality of structural members 20 as seen in FIG. 1, the receptacles 45 formed from a combination of structural members 20 hold roof joists 52 which are joined to a plurality of roof rafters 53 to form a standard roof structure as is known in the construction art. The roof joists 52 may be larger than the floor joists 50, but that is well within the skill of the art and is easily accommodated with the present invention since the receptacles 45 will accept construction timbers of any size.

Each of the floors 95 is supported by a molding 100 which is fastened to the wall studs 51 and which extends longitudinally along the wall studs 51 in order to provide an adequate support for the corresponding floor joists 50 and structural members holding same as well as for the roof joists 52 and the structural members 20 holding same.

As may be seen therefore, there has been provided a simplified metal structural member 20 which may be used to construct buildings from 1–6 stories high and any length desired which permits a crew of four to wreck the skin of a four story building in as little as 160 hours. The structural members may be connected together as shown on site to provide walls and floor/ceiling combinations in various dimensions, all from standard prefabricated structural units 20.

Further, the structural units 20 may be preformed in order to accommodate studs and joists of any desired size and length, the previous example being for standard "2×4" wall studs or "2×10" or "2×12" floor joists. It is also understood that the outer front panels 21 of the walls 80 may be embossed with any suitable decorative design to provide a pleasing appearance to the outermost skin of the building while the panels 21 forming the ceiling of the various ceiling/floors 90 may or may not be likewise embossed or decorated.

While there has been disclosed what is considered to be the preferred embodiment of the present invention, it is understood that various changes in the details may be made without departing from the spirit, or sacrificing any of the advantages of the present invention.

I claim:

1. Structural member having an elongated front panel with lateral ends, side panels extending generally perpendicular from said front panel and joined thereto at a respective one of said lateral ends, each of said side panels having a generally Z-shaped portion therein, and a flange at the end of each side panel extending toward the other side panel generally parallel to said front panel, whereby adjacent cooperating structural members are nestable with each other at the Z-shaped portions thereof with the flanges of nested side panels cooperating to form a support.

2. The structural member of claim 1, wherein said front and side panels are metal.

3. The structural member of claim 1, wherein the entire member is a single piece of steel.

4. The structural member of claim 1, wherein the front panel measures about 16 inches between its lateral ends.

5. The structural member of claim 4, wherein the longitudinal extent of said member is in the range of from about 5 feet to about 40 feet.

6. The structural member of claim 1, wherein the Z-shaped portions of both side panels are substantially the same.

7. The structural member of claim 1, wherein the Z-shaped portions of the side panels are different such that side panels of adjacent structural members are nestable to provide an elongated space for insulation or caulk.

8. A plurality of structural members connected together forming a building wall or ceiling and floor, each structural member having an elongated front panel with lateral ends and side panels extending generally perpendicularly from said front panel and joined thereto at a respective one of said lateral ends, each of said side panels having a generally Z-shaped portion therein and a flange at the end of each side panel extending toward the other side panel generally parallel to said front panel, adjacent structural members being nested with each other at the Z-shaped portions thereof with the flanges of nested side panels cooperating to form a support for a wall or floor, and means connecting adjacent side panels to form supports for a building wall or ceiling or floor.

9. The construction of claim 8, wherein said flange at the end of each side panel is a first flange and has a second flange at the end thereof generally perpendicular thereto extending away from said front panel, said first and second flanges cooperating to form a plurality of parallel elongated receptacles for wall studs or floor joists.

10. The construction of claim 9, wherein each structural member is a an integral steel member with the dimension between the side panels being about 16 inches to provide 16 inch between for each wall stud or floor joist.

11. The construction of claim 10, wherein the length of each receptacle formed by connected side panels is in the range of from about 10 feet to about 40 feet.

12. The construction of claim 10, wherein the side panels are connected by means of deforming one side panel into another at spaced intervals along the length of said side panels.

13. The construction of claim 10, wherein said structural members form a wall and further including a wood stud positioned within each receptacle and maintained therein by longitudinally spaced deformations of said second flanges into each stud.

14. The construction of claim 10, wherein said structural members form a floor/ceiling combination and further including a wood joist positioned within each receptacle and maintained therein by longitudinally spaced apart deformations of said second flanges into each joist.

15. A building including of a plurality of structural members connected together forming interconnected walls and floors, each structural member having an elongated front panel with lateral ends and side panels extending generally perpendicularly from said front panel and joined thereto at a respective one of said lateral ends, each of said side panels having a generally Z-shaped portion therein and a first flange at the end of each side panel extending toward the other side panel generally parallel to said front panel and a second flange at the end of said first flange generally perpendicular thereto extending away from said front panel, means connecting adjacent side panels to form said building walls and floors with the first and second flanges of each two connected side panels forming a longitudinally extending receptacle for a wall stud or floor joist, a wall stud positioned in vertically extending receptacles extending upwardly from near the bottom-most floor and extending downwardly from near the uppermost ceiling. an end panel horizontally extending across the tops of said wall forming structural members enclosing the tops of same, means, for connecting said end panels to said structural members, a floor joist positioned in horizontally extending receptacles, and means supporting and maintaining the floor-forming structural members with respect to the associated wall studs, said floor forming structural members having the front panels thereof forming a ceiling and the floor joists providing support for a floor to be positioned thereupon.

16. The building of claim 15, wherein said means for connecting said end panels to said structural members include a fixture which frictionally engages the associated side panel of said structural member between the Z-shaped portion thereof and said first flange and engages said end panel.

17. The building of claim 16, wherein said end panel has a plurality of apertures therein each dimensioned to receive a fixture therethrough, said fixture having a tab thereon which engages said end panel when said fixture is in frictional engagement with said side panel.

18. The building of claim 17, wherein said fixture comprises two generally rectangular sections angularly disposed to each other about a longitudinal mid axis, each of said rectangular sections having a tab extending generally perpendicular thereto at the end thereof, said fixture being dimensioned easily to fit between said Z-shaped portion and said first flange in each side panel such that said tabs contact the top surface of an associated end panel, straightening of said angularly disposed rectangular sections until the two sections are substantially planar resulting in said fixture frictionally engaging said side panel while said tabs engage end panel.

19. The building of claim 18, wherein the longitudinal edges of said rectangular sections have spaced apart nibs extending therefrom for engaging the associated side panel when the fixture is substantially planar.

20. The building of claim 15, wherein said means supporting and maintaining the floor-forming structural members with respect to the associated wall studs include a molding strip fixedly connected to said wall studs supporting said floor-forming structural members at a predetermined horizontal location.

* * * * *

UNITED STATES PATENT AND TRADEMARK OFFICE

CERTIFICATE OF CORRECTION

PATENT NO. : 5,117,602

DATED : June 2, 1992

INVENTOR(S) : Howard J. Marschak

It is certified that error appears in the above-indentified patent and that said Letters Patent is hereby corrected as shown below:

Column 6, line 37, "perpendicular" should be --Perpendicularly--.

Column 7, line 19, delete "a"--.

Column 7, line 33, after the word "spaced", insert --apart--.

Signed and Sealed this

Seventeenth Day of August, 1993

Bruce Lehman

*Attest:*

BRUCE LEHMAN

*Attesting Officer*

*Commissioner of Patents and Trademarks*